US006973816B2

(12) United States Patent
Couturier

(10) Patent No.: US 6,973,816 B2
(45) Date of Patent: Dec. 13, 2005

(54) DEVICE FOR STRAIGHTENING THE BODYWORK AND/OR THE STRUCTURES OF A MOTOR VEHICLE INVOLVED IN AN ACCIDENT

(76) Inventor: Alain Couturier, 5 rue de l'Artisanat Z.A. Des Deux Vallees, Vaugneray F-69670 (FR)

( * ) Notice: Subject to any disclaimer, the term of this patent is extended or adjusted under 35 U.S.C. 154(b) by 0 days.

(21) Appl. No.: 10/409,816

(22) Filed: Apr. 9, 2003

(65) Prior Publication Data

US 2004/0000185 A1 Jan. 1, 2004

Related U.S. Application Data

(63) Continuation of application No. PCT/FR01/03119, filed on Oct. 10, 2001.

(30) Foreign Application Priority Data

Oct. 11, 2000 (FR) ..... 00 12975

(51) Int. Cl.[7] ..... B21D 1/12; B21J 7/28

(52) U.S. Cl. ..... 72/453.15; 72/705; 60/537; 60/543

(58) Field of Search ..... 72/457, 705; 60/537, 60/539, 543, 584, 594; 173/113, 200, 201

(56) References Cited

U.S. PATENT DOCUMENTS 2,260,268 A * 10/1941 Warren et al. ..... 173/201

FOREIGN PATENT DOCUMENTS

| | | | |
|---|---|---|---|
| EP | 0 192 291 | 8/1986 | ..... B21D 1/12 |
| GB | 845 707 | 8/1960 | |

* cited by examiner

*Primary Examiner*—Lowell A. Larson
(74) *Attorney, Agent, or Firm*—Heslin Rothenberg Farley & Mesiti, P.C.; Victor A. Cardona, Esq.

(57) ABSTRACT

A device for straightening the body and the structures of a damaged vehicle, includes a master cylinder filled with hydraulic fluid, wherein moves a master piston under the action of a rotary member actuated by a motor. A slave cylinder is connected to the master cylinder through a flexible conduit extending from said master cylinder, and is designed to be connected by some means to the body or to the structure to be straightened. The slave cylinder receives a slave piston, driven in translation inside the slave cylinder under the action of the hydraulic fluid, so as to be urged to strike the neighbourhood of the end of said slave cylinder connected to the body or to the structure, by being subjected to a return force tending to bring it back to its initial position.

9 Claims, 11 Drawing Sheets

DEVICE FOR STRAIGHTENING THE BODYWORK AND/OR THE STRUCTURES OF A MOTOR VEHICLE INVOLVED IN AN ACCIDENT

CROSS REFERENCE TO RELATED APPLICATIONS

This application is a continuation of international application PCT/FR01/03119 filed Oct. 10, 2001 and published, in French, as WO 02/30588 A1 on Apr. 18, 2002, and claims priority of French application no. 00.12975 filed Oct. 11, 2000, the entire contents of these applications is incorporated by reference herein.

The present invention relates to a device for straightening and in particular for repairing the bodywork or the structures of motor vehicles involved in accidents.

Conventionally, such a repair is carried out using hydraulic rams, which are incorporated in various known systems such as straightening benches, vector systems or else jacking stations.

Putting this type of system in place is lengthy and tedious and involves pressing on the vehicle, or fixing the vehicle securely to the straightening system. Such a system is for example described in document EP-A-0 192 291.

The object of the present invention is to simplify these straightening and repair operations, especially by means of a portable device, capable of developing considerable power. Such a system can be reversibly fixed to the vehicle and can be oriented in any direction such that the straightening forces are exerted accurately in the desired direction. It is designed to allow tensile or pressure forces to be produced without lengthy and difficult handling of the structures in question, and without even requiring the vehicle to be fixed, as the weight of the latter is enough to prevent any movement thereof during the straightening action.

The device according to the present invention thus comprises:

- an emitting cylinder, filled with hydraulic fluid, in which an emitting piston moves under the action of a rotary member rotated by means of a motor;
- a portable receiving cylinder, connected to the emitting cylinder by means of a hose, said receiving cylinder being designed to be connected by any means to the bodywork or to the structure to be straightened and receiving a piston moving translationally within said cylinder under the action of the hydraulic fluid, so as to strike close to the end of said receiving cylinder connected to the bodywork or to said structure.

Advantageously, the movement or striking frequency of the piston within the portable receiving cylinder is between 50 and 100 blows per second.

Furthermore, according to an advantageous feature of the invention, the rotary member consists of a cam with a noncircular profile, of a connecting rod associated with a camshaft or of an equivalent member. It is designed to transform a rotary movement into a reciprocating translational movement.

In addition, to increase the speed of the piston, and therefore the striking power, the diameter of the portable receiving cylinder is less than the diameter of the emitting cylinder. The speed of the piston within the receiving cylinder is increased in proportion to the difference in effective cross sections.

According to an advantageous feature of the invention, the emitting cylinder communicates with at least one hydraulic fluid accumulation chamber, the accumulation volume of which is adjustable by means of a piston, whose travel is limited with a threaded rod, said piston closing off access to said accumulation chamber in the absence of external stress, under the action of compressed air or of a preloaded spring.

According to another variant of the invention, said piston of the accumulation chamber is static, and is therefore not subjected to the action of compressed air or of any preloaded spring. In this configuration, it becomes possible to adjust the amount of hydraulic fluid likely to remain in the receiving cylinder, so as to form a stop against which the receiving piston presses when it is subjected to the return force tending to bring it back to its original position.

The way in which the invention can be embodied and the advantages resulting therefrom will become more apparent in the following exemplary embodiment, given by way of non-limiting indication with the support of the appended figures.

The device according to the invention is therefore particularly described in relation to FIGS. 2 to 9. It is made of steel.

Fundamentally, the latter first of all comprises an emitting cylinder CE, in which an emitting piston PE moves under the action of a rotary member. The latter consists, in the example described, of a cam C with a noncircular profile and, in particular, an ellipsoidal profile, which transforms a circular movement (that of the cam) into a reciprocating movement of the emitting piston PE. This cam is itself rotated by an electric motor or a heat engine (not shown) so as to cause the piston PE to move with reciprocal translation, and one of its ends to press on the cam path. This cam C causes, at the start of each cycle, the thrust of hydraulic fluid, and in this case, of oil contained by the device, via the emitting piston PE.

As already mentioned, the system is filled with a hydraulic fluid, in particular oil. On the other hand, the oil cannot enter the rotation volume of the cam, the piston PE being fitted with an O-ring seal J1 for this purpose.

This emitting cylinder communicates, via a hose F, with a portable receiving cylinder CR, designed to be fastened to the bodywork or to the structure to be straightened by any known means, and especially by means of an anchoring part.

A receiving piston PR slides within the receiving cylinder CR, under the action of the oil routed to this level by the hose F. It is therefore understood, that given the fact that the emitting cylinder CE and the hose F are filled with oil, this oil is transmitted via the hydraulic hose F within the portable receiving cylinder CR by movements of the emitting piston PE, itself activated by the cam C.

Figure 10:
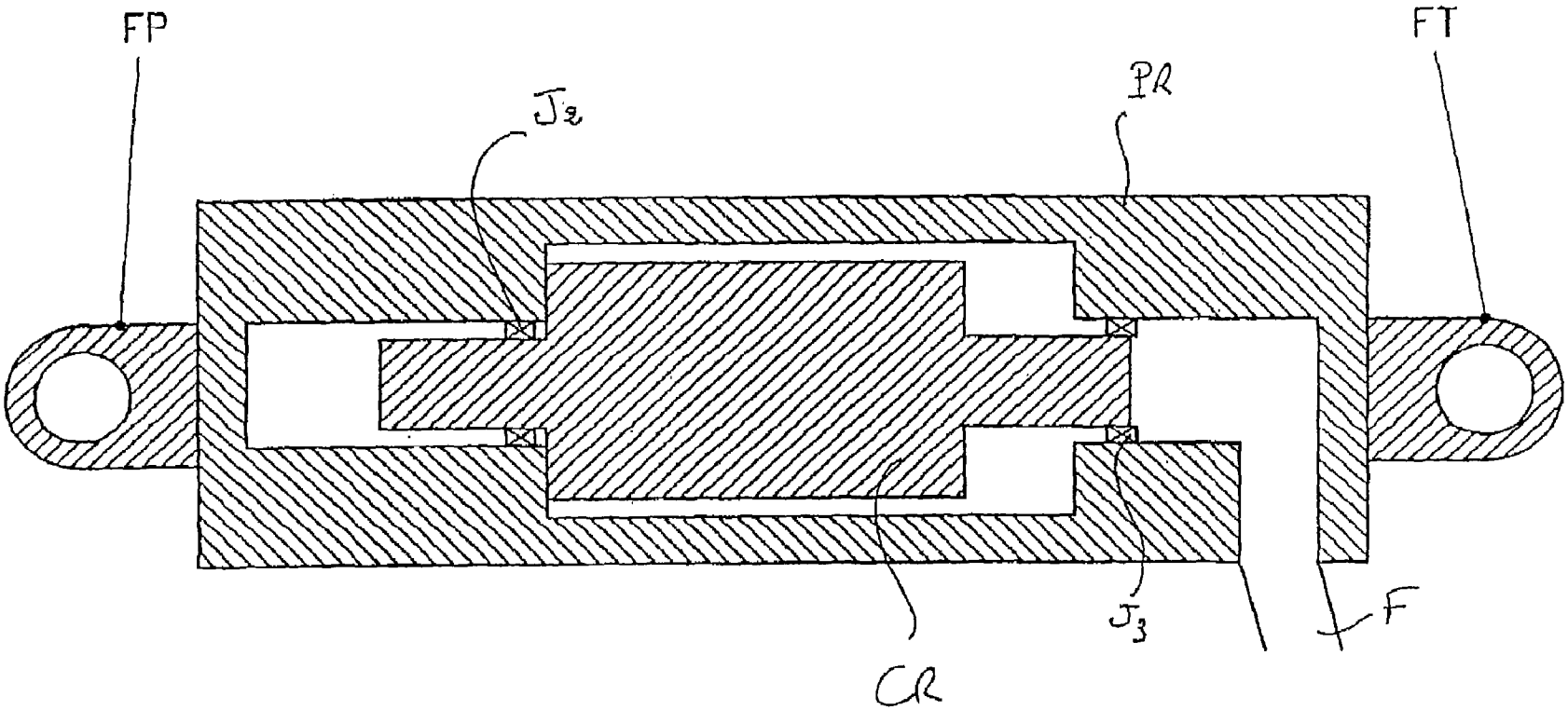
FIG. 10 is a detailed schematic representation of a receiving cylinder fitted with the receiving piston.

At the end of travel, the receiving piston PR strikes the end wall FA of the receiving cylinder CR. Thus, as can be seen in FIG. 10, this receiving cylinder and the receiving piston have complementary shapes, such that the receiving piston is guided in its translation within the receiving cylinder. To prevent the introduction of oil into the translation chamber of said cylinder, the latter is provided at its two respective ends with O-ring seals J2 and J3, this being done in a known manner.

When the receiving piston strikes the end wall FA of the receiving cylinder, it generates a force of varying power, which is dependent on the mass and the speed of the piston on impact.

The receiving piston PR is then pushed back by a preloaded spring (not shown) or a compressed gas, so that it returns to its initial position at the start of travel, simultaneously leading to returning the oil which activated it, which oil pushes back the emitting piston PE while still pressing on the cam path, said cam C returning to its initial position. Each rotation of the cam leads to a complete movement cycle of the respective pistons.

The number of cycles per second depends on the rotation speed of the cam. The higher the number of cycles per second, the higher the striking frequency, which can almost reach a continuum in terms of pressure or of traction exerted on the structure to be straightened.

According to the invention, and as is shown in FIG. 10, the receiving cylinder has two ends and especially anchoring lugs FP and FT, respectively, depending on the nature of the action to be carried out on the structure, the end FP designed to enable pressure to be exerted, and the end FT being designed to allow traction to be exerted.

The frequency of striking, and therefore of the cycles, is advantageously between 50 and 100 blows per second, leading to a phenomenon in which the amplitude of the vibrations of the structure to be straightened increase when the period of the vibrations imposed or one of its harmonics becomes equal to the natural vibration period of the vehicle to be repaired, this resonant phenomenon contributing beneficially to the straightening of the bodywork or the damaged structures.

According to an advantageous feature of the invention, the device also comprises means for adjusting the force generated by the receiving piston PR striking on the end wall FA of the receiving cylinder CR.

Figure 1:
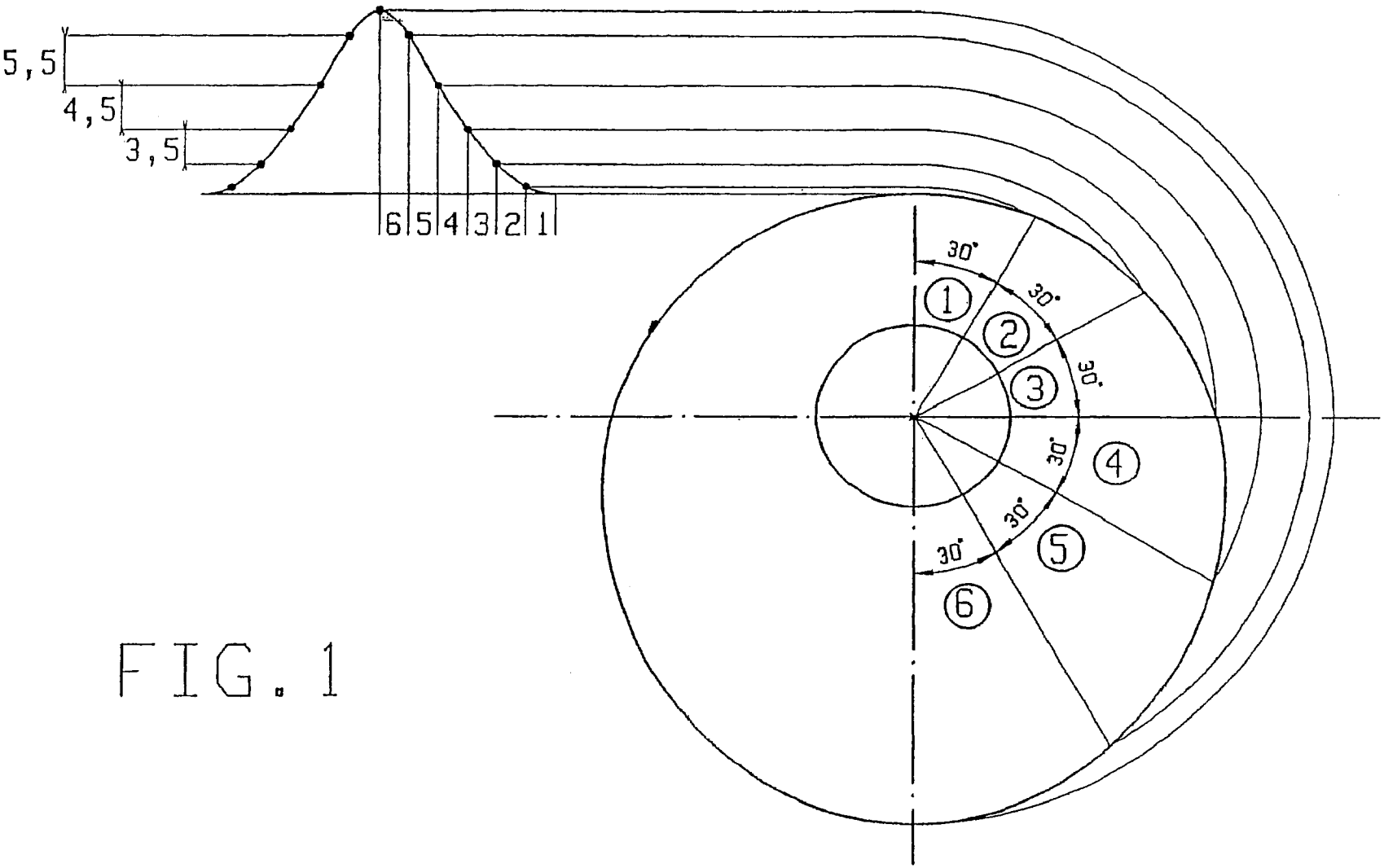
FIG. 1 is a schematic representation of the rotary member, in this case consisting of a cam, aiming to illustrate the linear speed of the emitting piston as a function of the angular coordinates of the rotary member.
Figure 2:
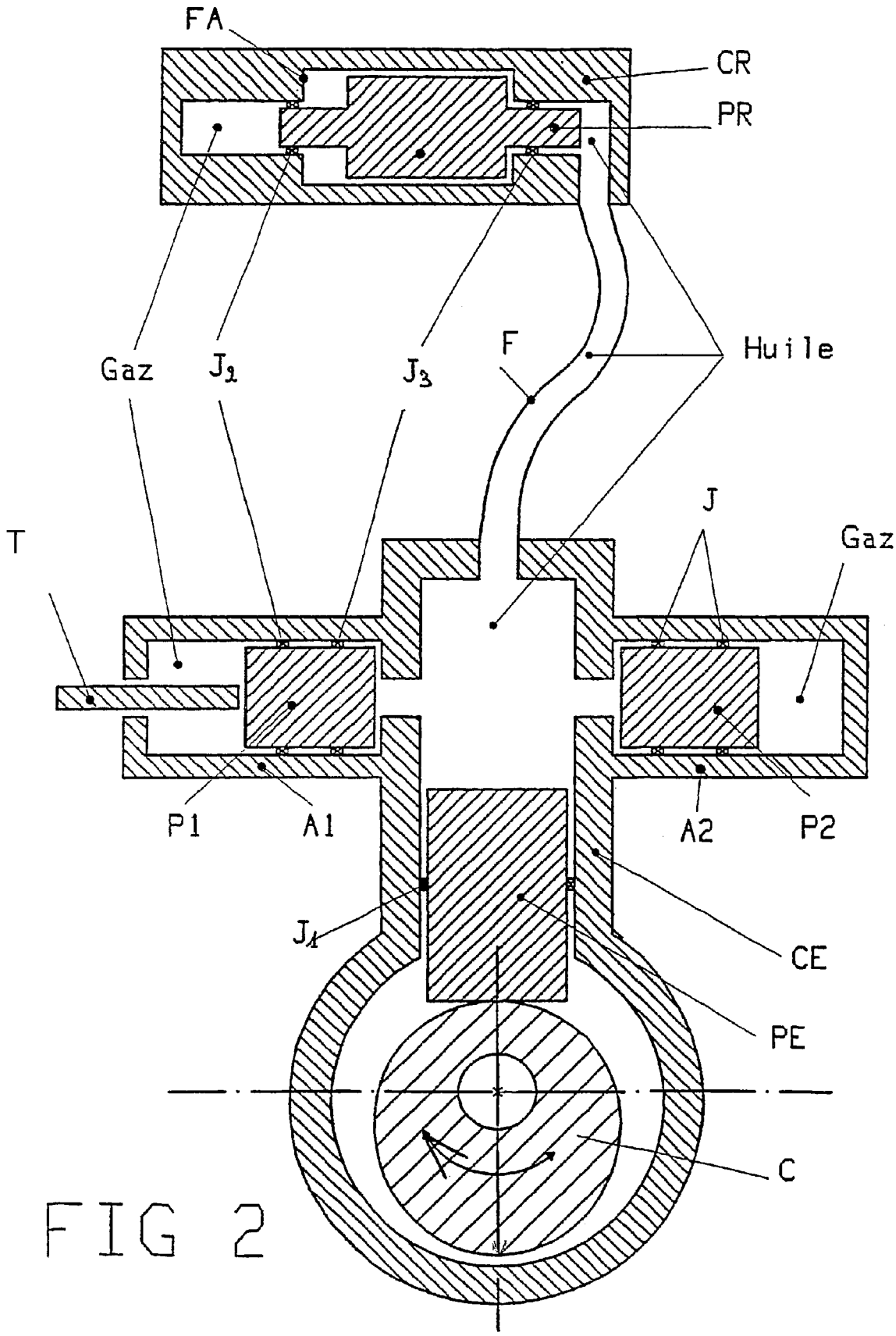
FIGS. 2 to 9 are schematic sectional representations of the device according to the invention in different operating phases.
Figure 3:
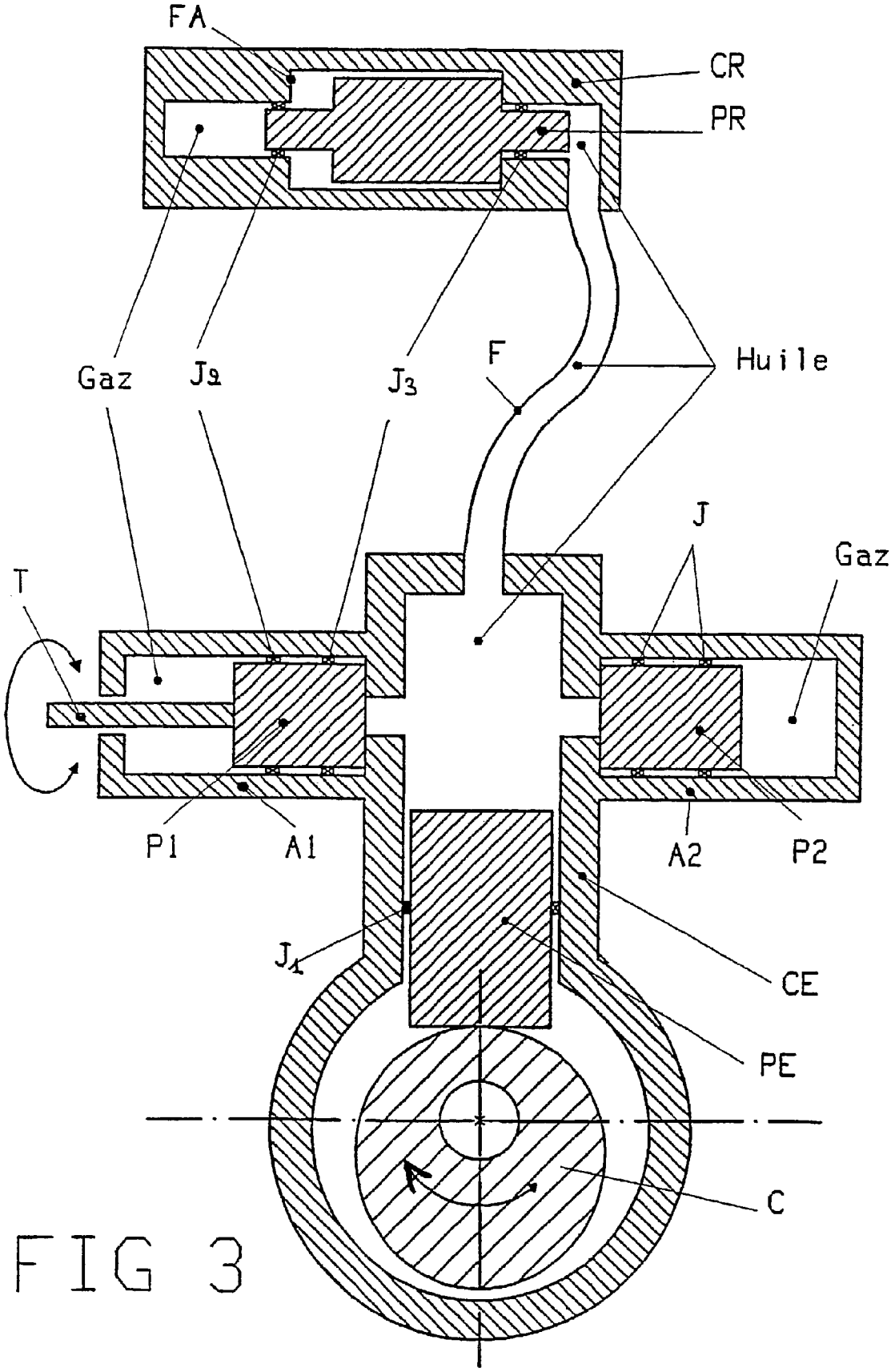
Figure 4:
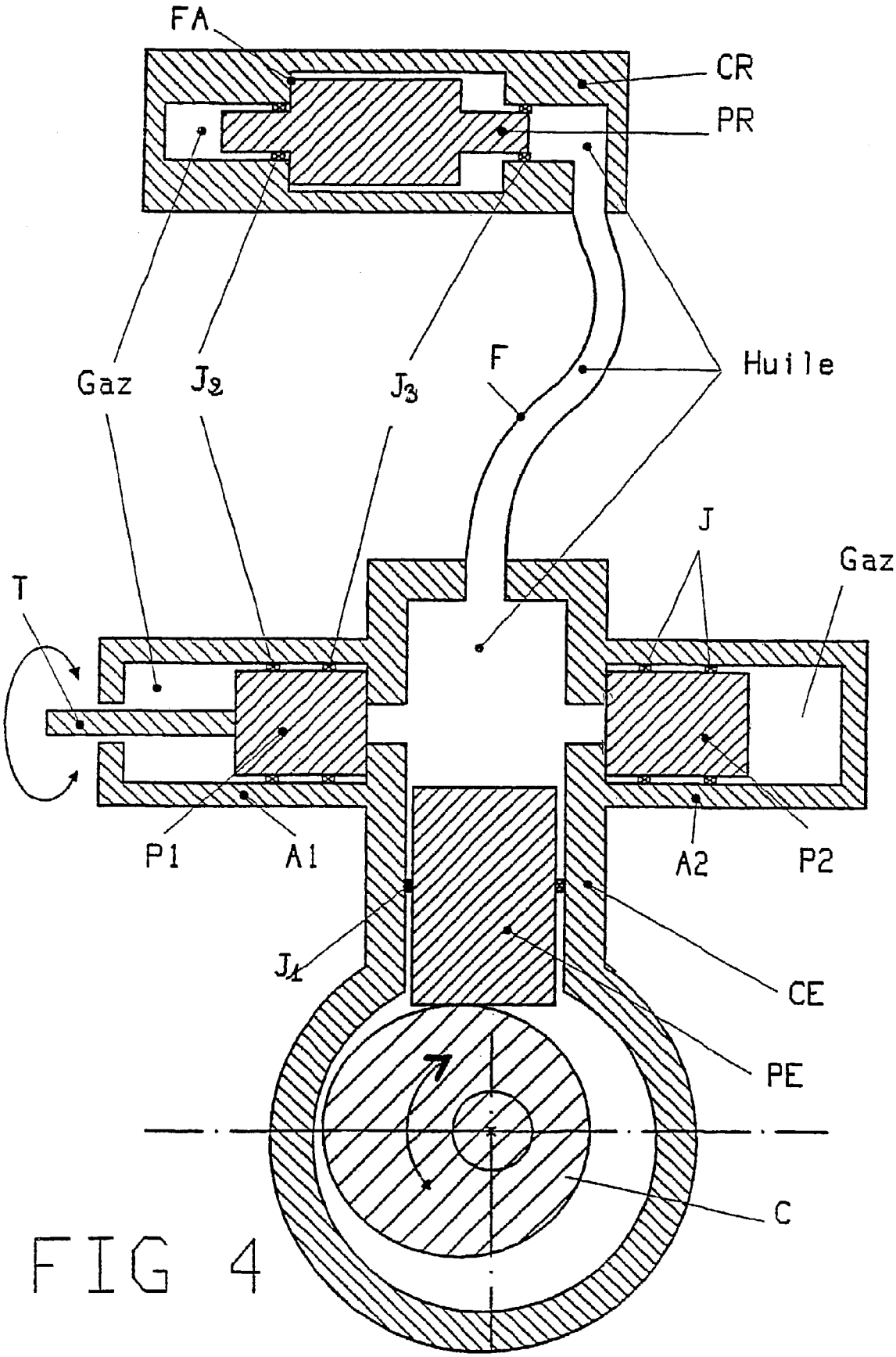

It will be recalled that the cam C, rotated by an electric motor or a heat engine, gives the emitting piston PE a straight movement which varies uniformly on the outward and return stroke. The linear speed of the emitting piston PE is small at the start of rotation of the cam C (close to the bottom dead center—FIG. 1), and increases at the middle of travel to become smaller at the end of travel (top dead center).

The travel of the emitting piston PE and its diameter contribute to the fact that an amount of oil is moved, much greater than the amount of oil needed to move the receiving piston PR, whose diameter is less than the diameter of the emitting piston PE, which, because of the differences in effective surface areas, increases proportionally with the speed of the receiving piston PR.

All that is required is therefore to choose the sector of the cam (FIG. 1) which will give the desired speed to the emitting piston PE and therefore, via the oil, to the receiving piston PR at the moment of impact. The striking force of the receiving piston PR is proportional to the mass of the latter and to the square of its speed, such that it can be adjusted.

To do this, the device comprises an oil accumulation chamber A1, communicating with the emitting cylinder CE. The volume of this chamber can be adjusted by means of a threaded rod whose end bears a piston P1, able to move within this chamber. The travel of the piston within the accumulation chamber A1 is therefore adjustable. Furthermore, one of the regions of said chamber, not capable of being filled with oil, is filled with a compressed gas or incorporates a preloaded spring (not shown), for causing said chamber to be closed off by the piston P1 in the absence of external stress.

Thus, if a moderate striking force is required from the receiving piston PR, the threaded rod T is screwed as tight as possible (FIG. 3) so as to prevent any movement of the piston P1, and thus to prevent oil entering the chamber A1. In this configuration, given the fact that the volume of oil is constant, and that it therefore cannot enter the accumulation chamber A1, the rotation of the cam C generates the thrust of the emitting piston PE, which in its turn immediately causes the oil to move to the receiving piston PR, which thus strikes the end wall FA of the receiving cylinder at a fairly moderate speed (FIG. 4), since it corresponds to a region of the cam close to the bottom dead center. In other words, according to this configuration, the involved sector of the cam gives low power to the piston PE, which in its turn communicates a low speed to the piston PR, and consequently a low striking force.

Figure 5:
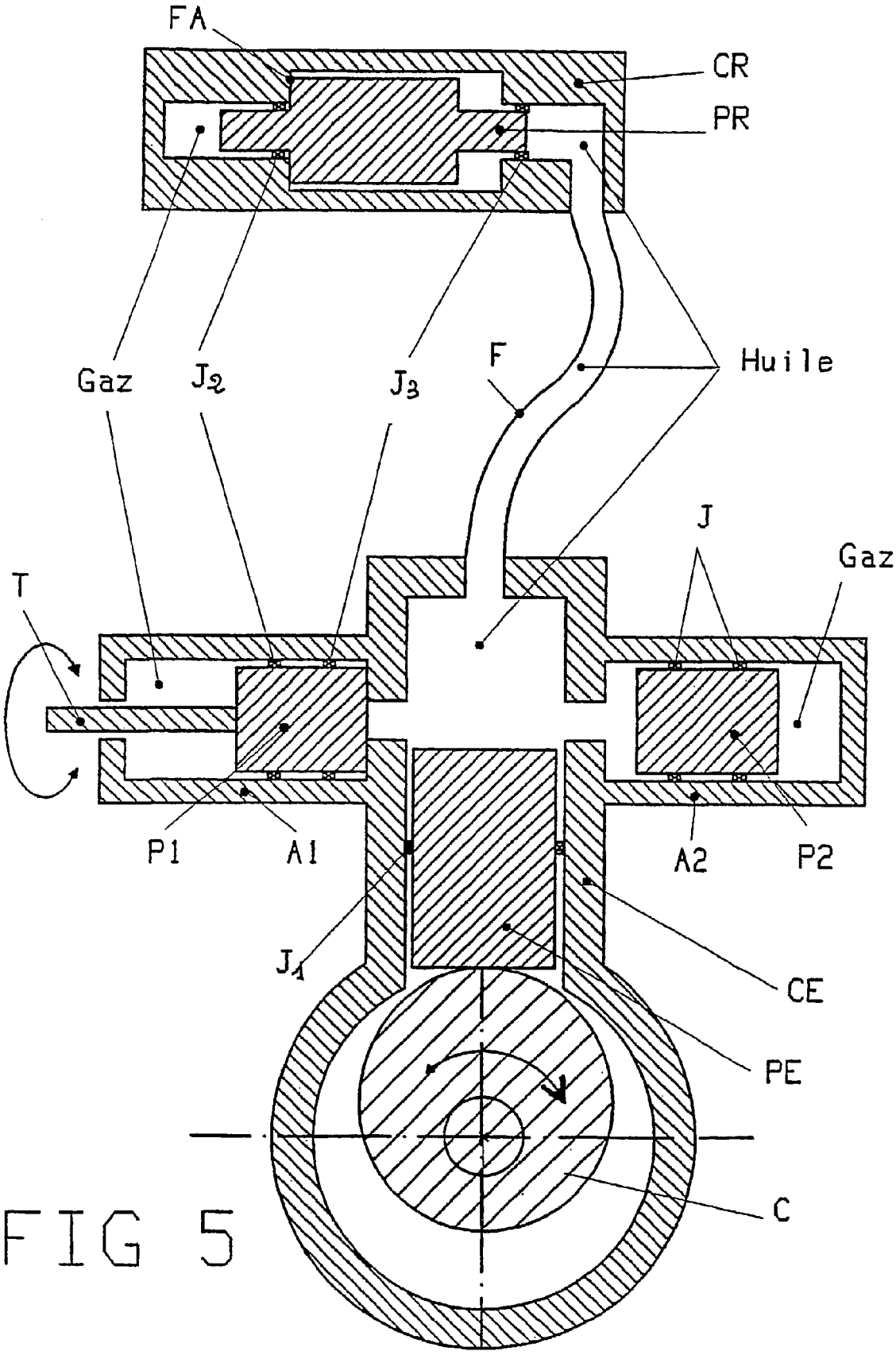

The oil surplus expelled by the emitting piston PE is stored in a second accumulation chamber A2, also communicating with the emitting cylinder CE. In the absence of external stress, such as for example the thrust of the oil, this chamber A2 is also closed off by a piston P2, held in place in this closed configuration either by a preloaded spring (not shown), but with a spring constant greater than that of the spring acting on the piston P1, or by a gas compressed to a pressure greater than the pressure of the compressed gas acting on the piston P1. In other words, the piston P2 requires an oil pressure from the emitting cylinder which is greater than that able to act on the piston P1 to bring about its movement in the accumulation chamber A2, and consequently the release of a temporary accumulation volume of oil coming from said emitting cylinder CE. The loading of the piston P2 is thus chosen so that it is greater than the force acting on the receiving piston PR by the preloaded spring or the compressed gas, such that the piston P2 cannot come into action before the receiving piston PR of the receiving cylinder has struck the end part FA of said receiving cylinder (FIG. 5). In other words, the physical variables controlling the piston P2 are higher than those controlling the return force of the receiving piston PR, which are themselves greater than those acting on the piston P1.

Figure 6:
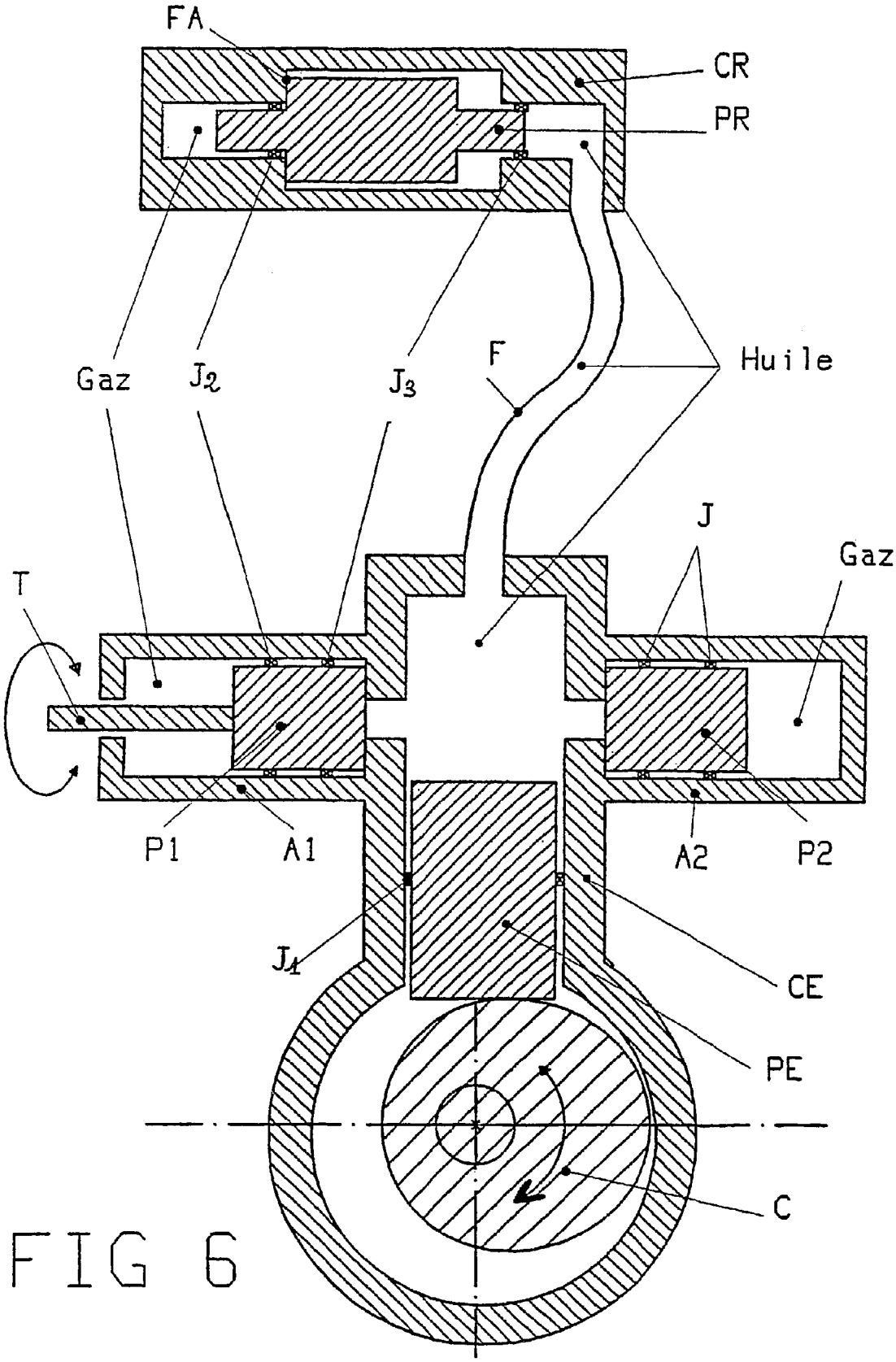
Figure 7:
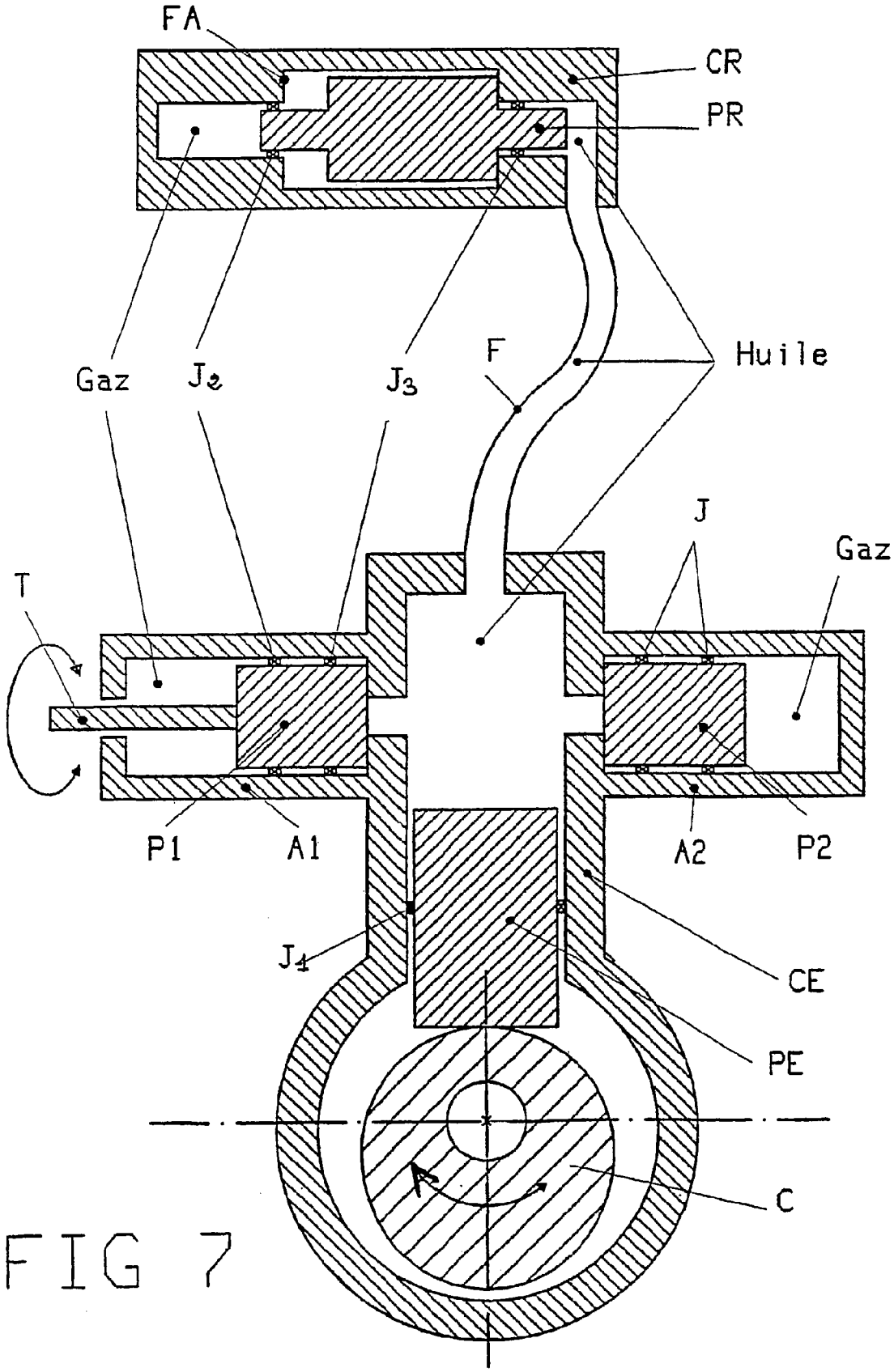
Figure 8:
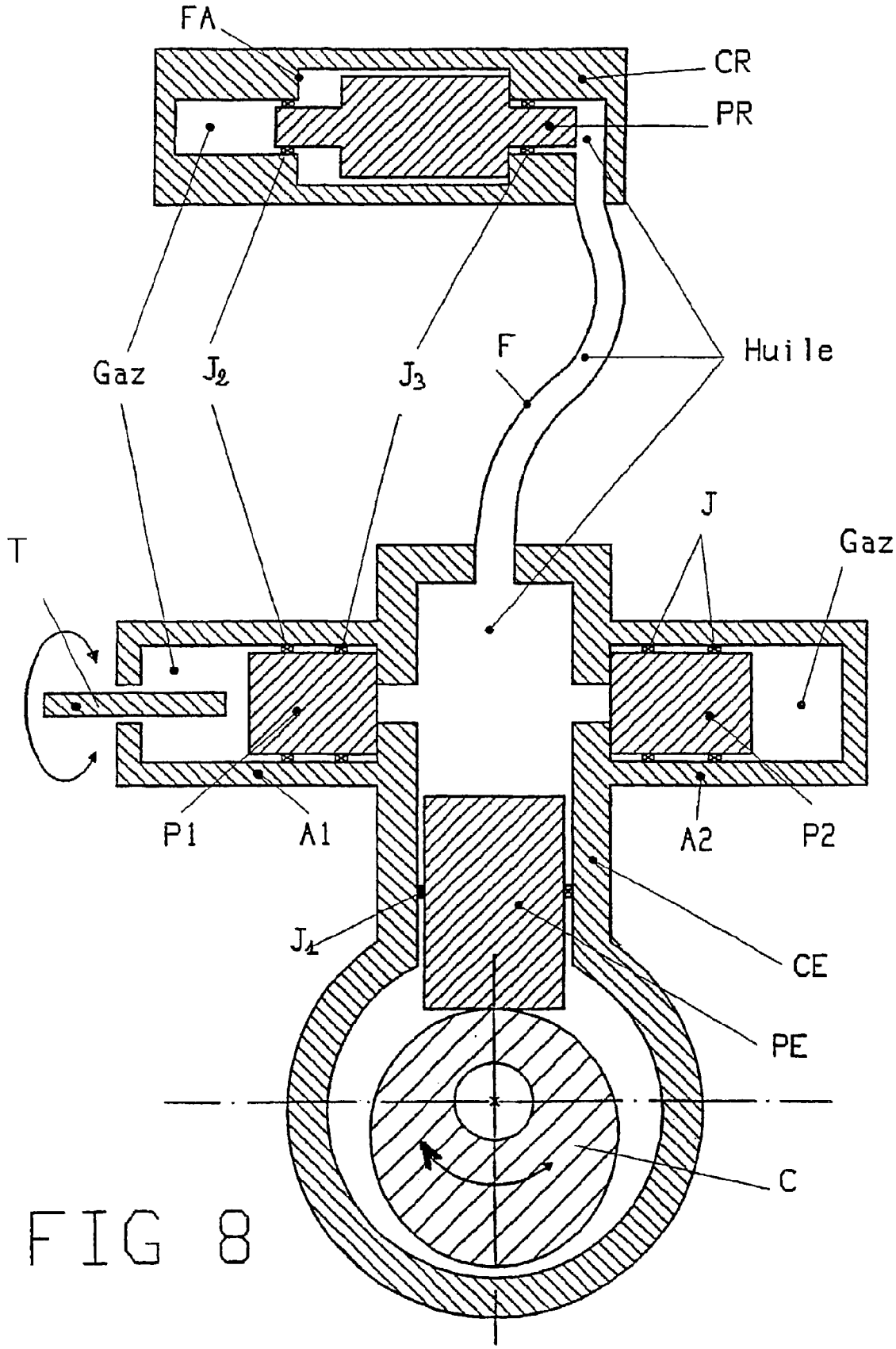
Figure 9:
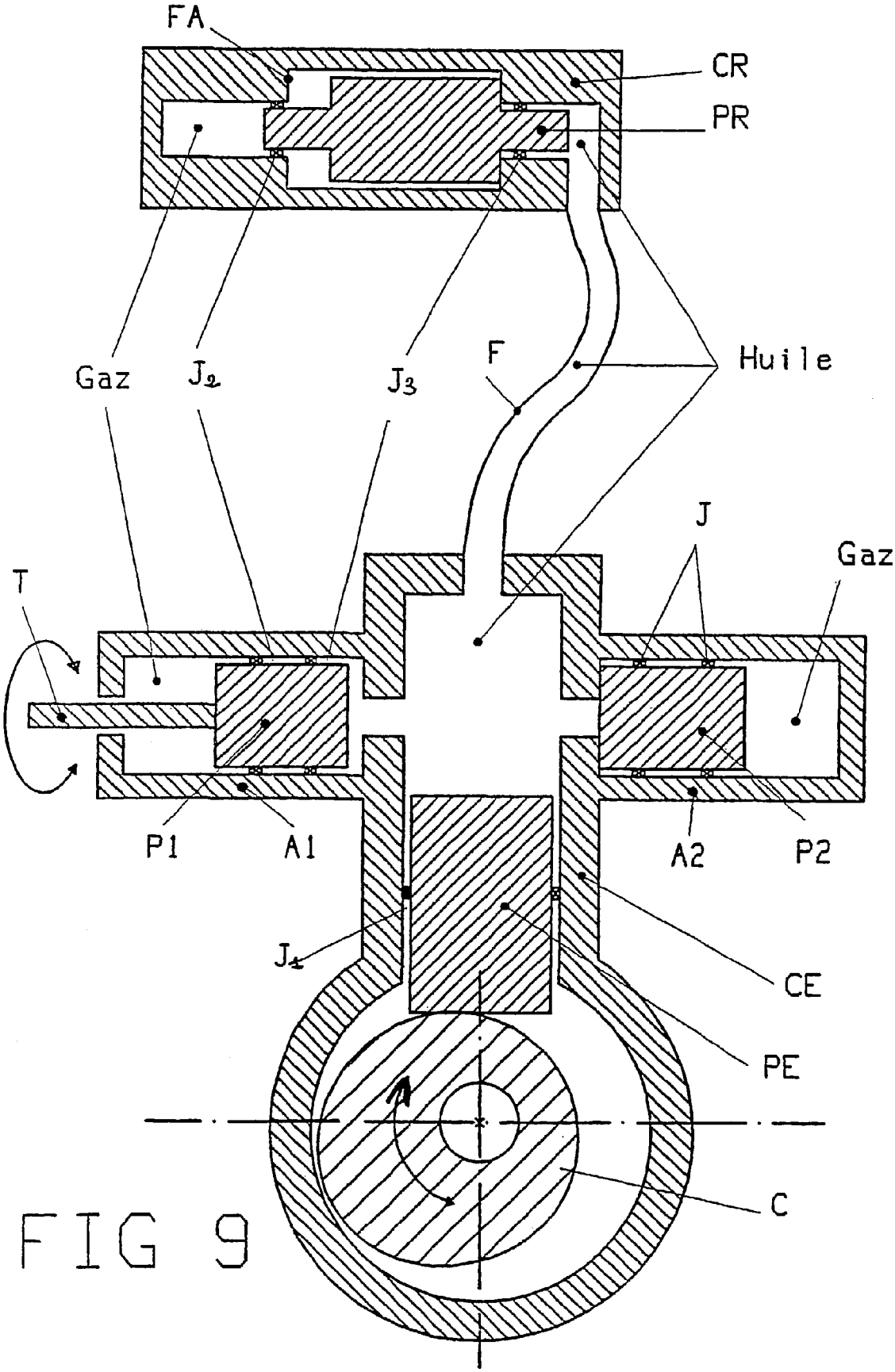

During the second phase of the cycle, the emitting piston PE goes back down, given the movement from the path of the cam on which it rests, and makes it possible for the accumulation chamber A2, whose pressure, generated by the piston P2, is very high, to empty (FIG. 6). The receiving cylinder CR, whose return spring loading, or whose compressed gas pressure, are less than the corresponding physical variables of the accumulation chamber A2, may then empty (FIG. 7).

At the end of these various operations, the cam C has completed its cycle and is back at its starting point, ready for a new cycle.

If on the other hand, it is desired to have a greater striking force for the receiving piston, the threaded rod T (FIG. 8) is unscrewed. Thus, the piston P1 is immediately moved under the action of the oil expelled by the emitting piston PE, making it possible to store the oil in the accumulation chamber A1 until the piston P1 abuts against the threaded rod (FIG. 9), which stops its travel. The accumulation chamber A1 comes into action first, since its return spring is the most weakly loaded, or the pressure of the compressed gas is the lowest with respect to the corresponding physical variables of the accumulation chamber A2 or of the receiving piston PR, as already specified above.

When the accumulation chamber A1 has stored a quantity of oil corresponding to a low speed of the emitting piston, itself dependent on the position of the cam (see FIG. 1), the speed of the emitting piston increases, since it corresponds to a region of the cam path where the speed is higher, and pushes the receiving piston PR, which in its turn then strikes the wall FA of the receiving cylinder CR, this being achieved at a higher speed than during the previous configuration, bringing about a larger striking force. The surplus of oil expelled by the emitting piston PE is stored in the accumulation chamber A2, with regard to which it will be recalled that the loading of the return spring is greater or that the pressure of the compressed gas is higher.

In the second part of the cycle, the emitting piston PE goes back down and firstly allows the accumulation chamber A2 to empty, given the properties of its return member (spring or compressed gas). Next, the receiving cylinder CR is emptied for the same reason. Finally, the accumulation chamber A1 is emptied, given the weakest properties of its return member.

Adjusting the threaded rod T makes it possible, depending on its position, to adjust the travel of the piston P1 very accurately in the accumulation chamber A1, and consequently to choose with accuracy the speed of the emitting piston PE as a function of the position of the cam C when the piston PR strikes the end wall FA of the receiving cylinder.

It will therefore be appreciated that the number of adjustments is infinite between the lowest speed corresponding to a low lift of the cam C, enough to move the receiving piston PR over its whole travel, and the highest speed corresponding to a higher lift of the cam C, leading to a maximum linear speed of movement of the piston PE, therefore of the receiving piston PR. This cam may be replaced by a camshaft and a connecting rod connected to the emitting piston PE.

It will also be appreciated that it is possible to vary the striking force in relation to the speed of the receiving piston, which is dependent on the one hand on the rotational speed of the cam C, and on the other hand, on the adjustment of the volume of the accumulation chamber A1. A procedure for adjusting the accumulation chamber is therefore carried out, via the threaded rod T, in order to select the striking force of the receiving piston. In addition, action is also taken on the rotational speed of the cam C, so as to determine the power or the striking force. This rotational speed causes the emitting piston PE and the receiving piston PR to have a varying speed of movement. Since the striking force, as already mentioned, depends on the mass of the receiving piston PR, and on the square of its speed, the higher the speed the greater the striking force. This speed also affects the frequency of the impacts enabling the straightening.

The variation in the speed of the emitting piston PE may be obtained by various means, such as for example an electronic variable speed drive for the motor rotating the cam C or else by means of a variable speed drive employing gears.

Figure 11:
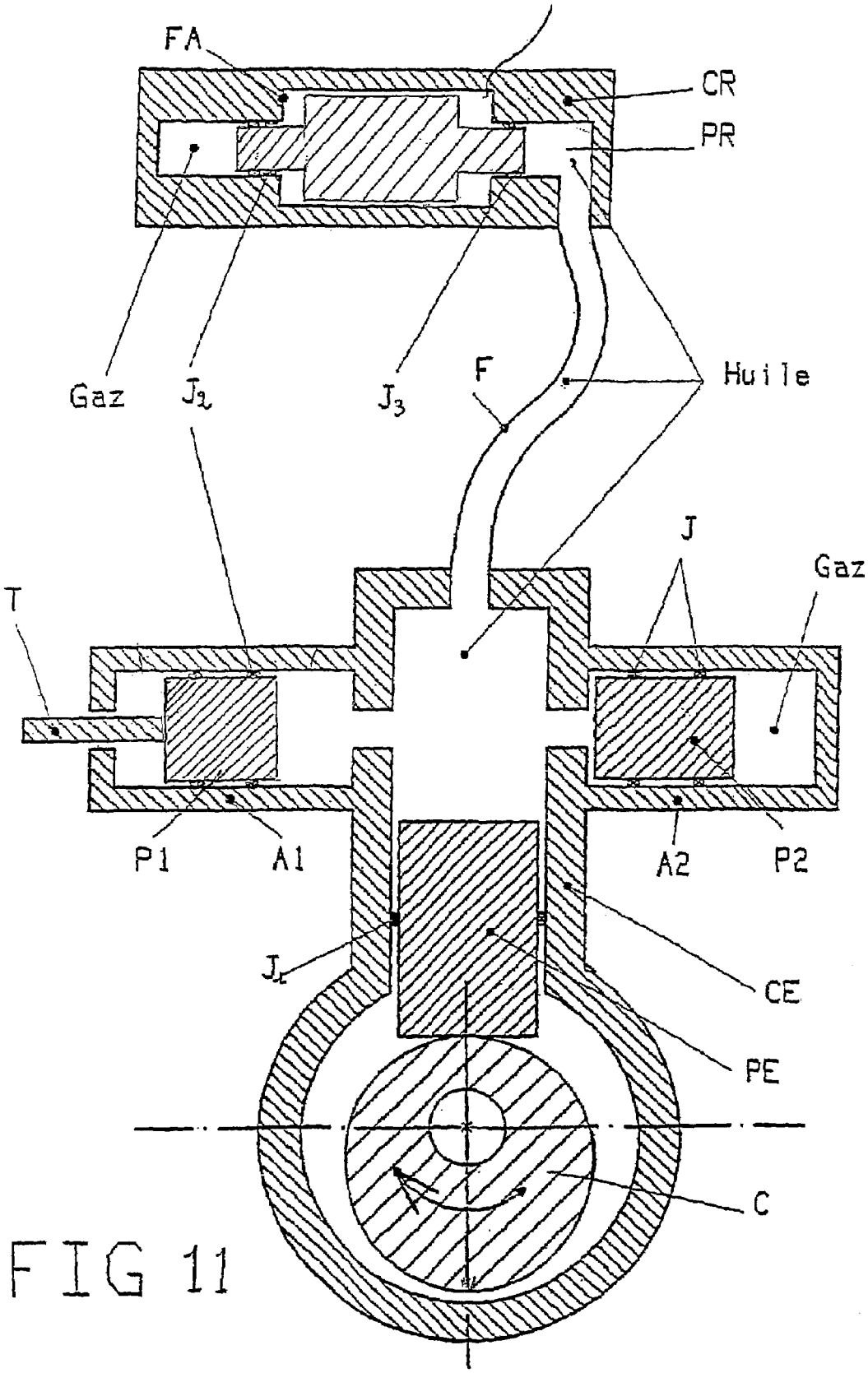
FIG. 11 is a view similar to any one of FIGS. 2 to 9, illustrating a second embodiment of the device according to the invention.

According to one variant of the invention illustrated in relation to FIG. 11, the piston P1 of the accumulation chamber A1 has no return force. In other words, the region of said chamber which is not accessible to the oil has neither a preloaded spring nor compressed gas, but communicates freely with the outside air. Said piston P1 is therefore static during operation of the device of the invention.

In fact, under the action of the oil expelled by the emitting piston PE, or under the action of the oil expelled by the receiving piston PR during action of the return forces generated at the latter by the loaded return spring or by the compressed gas, the piston simply rests on the free end of the threaded rod T defining, depending on the adjustment of the latter, a predetermined volume within the accumulation chamber A1.

As such, given the constant volume of oil within the complete device, increasing or decreasing the volume of oil within the accumulation chamber A1 has the effect of moving the receiving piston PR away from or bringing it close to the striking region FA, said receiving piston remaining continuously bearing against the oil, given the aforementioned return forces to which it is subject.

In other words, during the return phase of the receiving piston PR, that is to say after having struck against the end wall FA of the receiving cylinder CR, a varying amount of oil can be held within said receiving cylinder, suitable for damping or even preventing the impact of the receiving piston against the upstream part PA of said receiving cylinder. This result proves to be of considerable importance in the operation and durability of the device, given the operating frequencies and the feedback phenomena observed at such frequencies.

Furthermore, this embodiment of the invention makes it possible to keep the adjustment of the striking force of the receiving piston PR on the end wall FA of the receiving cylinder CR. Specifically, if said receiving piston PR is positioned in a region relatively close to the end wall FA because of the reduction of the available volume of the accumulation chamber A1, a small movement of the emitting piston PE is necessary in order to push the receiving piston PR and to strike said end wall FA. This small movement of the emitting piston PE is brought about by one sector of the cam C close to the bottom dead center. In other words, according to this configuration, the sector of the cam C involved gives a low speed to the emitting piston PE, which in its turn communicates a low speed to the receiving piston PR, and consequently a low striking force at the FA.

If the volume of the accumulation chamber A1 is increased, the receiving piston PR moves away from the striking region FA, such that a greater movement of the emitting piston PE is necessary, so as to push enough oil so that the receiving piston PR strikes the end wall FA of the receiving cylinder CR. This greater movement of the emitting piston PE is brought about by greater rotation of the cam C, and at the time of the impact of the receiving piston PR on the end wall FA, the sector of the cam C in contact with the emitting piston PE is located between the bottom dead center and the top dead center, giving a greater speed to the emitting piston PE. In other words, according to this configuration, the sector of the cam C involved at the time of impact of the receiving piston PR on the FA gives a greater speed to the emitting piston PE, which in its turn communicates a high speed to the receiving piston PR, and consequently a high striking force at the FA.

A static adjustment procedure is therefore carried out on the piston P1, which does not undergo movement during the operating cycle of the device.

It will therefore be appreciated that the number of adjustment points is infinite between the two configurations described above, which makes it possible to vary the volume of the accumulation chamber A1 by the action of the threaded rod T.

What is claimed is:

1. A device for straightening the bodywork and the structures of a vehicle involved in an accident comprising:

an emitting cylinder filled with hydraulic fluid, in which an emitting piston moves under the action of a rotary member actuated by a motor;

a portable receiving cylinder connected to the emitting cylinder by a hose extending from said emitting cylinder, and connected to the bodywork or to a structure to be straightened, said receiving cylinder receiving a receiving piston, moving translationally within the receiving cylinder under action of the hydraulic fluid, so as to strike close to an end of said receiving cylinder connected to the bodywork or to the structure, and being subjected to a return force tending to bring the receiving piston back to an original position; and wherein said receiving cylinder comprises a pressure applying end and a traction applying end, wherein the movement of said receiving piston causes at least one of pressure to be supplied to said pressure applying end and traction to be supplied to said traction applying end.

2. The device for straightening the bodywork and the structures of a vehicle involved in an accident as claimed in claim 1, wherein the return force tending to bring the receiving piston back to the original position is brought about by air or compressed gas or a preloaded spring.

3. The device for straightening the bodywork and the structures of a vehicle involved in an accident as claimed in claim 1, wherein a movement frequency, and consequently frequency of impacts generated by the receiving piston is between 50 and 100 blows per second.

4. The device for straightening the bodywork and the structures of a vehicle involved in an accident as claimed in claim 3, wherein the movement frequency, and consequently the frequency of the impacts generated by the receiving piston is tuned to resonant frequency of the structure to be straightened or to one of its harmonics.

5. The device for straightening the bodywork and the structures of a vehicle involved in an accident as claimed in claim 1, wherein the rotary member comprises a cam with a noncircular profile or a camshaft associated with a connecting rod or an equivalent device, giving the emitting piston a reciprocal translational movement.

6. The device for straightening the bodywork and the structures of a vehicle involved in an accident as claimed in claim 1, wherein diameter of the receiving cylinder is less than diameter of the emitting cylinder.

7. The device for straightening the bodywork and the structures of a vehicle involved in an accident as claimed in claim 1, wherein the emitting cylinder communicates with at least one accumulation chamber of the hydraulic fluid, whose volume can be adjusted via a piston associated with a threaded rod, said piston being, in the absence of stress, held in closed position of said accumulation chamber by force of air or compressed gas or a preloaded spring.

8. The device for straightening the bodywork and the structures of a vehicle involved in an accident as claimed in claim 7, wherein the emitting cylinder communicates with a second accumulation chamber also associated with a piston held, in the absence of external stress, in closed position of the second accumulation chamber by force of air or compressed gas or a preloaded spring, said force being higher than the return force on the receiving piston, and greater than the force acting on the piston of the at least one accumulation chamber.

9. The device for straightening the bodywork and the structures of a vehicle involved in an accident as claimed in claim 1, wherein the emitting cylinder communicates:

on the one hand, with an accumulation chamber for the hydraulic fluid, whose volume can be adjusted by means of a piston associated with a threaded rod, said piston not being subject to any stress other than that of the hydraulic fluid able to enter the volume which it defines within the accumulation chamber, and on the other hand, with a second accumulation chamber also associated with a piston held, in the absence of external stress, in closed position of said second accumulation chamber by force of air or compressed gas or a preloaded spring, said force being higher than the return force on the receiving piston.

* * * * *